US009303645B2

(12) United States Patent
Oakman

(10) Patent No.: US 9,303,645 B2
(45) Date of Patent: Apr. 5, 2016

(54) REGENERATIVE BLOWER WITH A CONVOLUTED CONTACTLESS IMPELLER-TO-HOUSING SEAL ASSEMBLY

(71) Applicant: VICTORI, LLC, Boulder, CO (US)

(72) Inventor: Joel Jack Oakman, Lakewood, CO (US)

( * ) Notice: Subject to any disclaimer, the term of this patent is extended or adjusted under 35 U.S.C. 154(b) by 505 days.

(21) Appl. No.: 13/848,284

(22) Filed: Mar. 21, 2013

(65) Prior Publication Data

US 2013/0251514 A1 Sep. 26, 2013

Related U.S. Application Data

(60) Provisional application No. 61/614,899, filed on Mar. 23, 2012.

(51) Int. Cl.

| | |
|---|---|
| ***F01D 1/12*** | (2006.01) |
| ***F04D 1/04*** | (2006.01) |
| ***F04D 3/00*** | (2006.01) |
| ***F04D 23/00*** | (2006.01) |
| ***F04D 29/08*** | (2006.01) |

(52) U.S. Cl.

CPC ..... *F04D 3/00* (2013.01); *F04D 23/008* (2013.01); *F04D 29/08* (2013.01)

(58) Field of Classification Search

CPC ..... F04D 3/00; F04D 23/008
USPC ..... 415/55.1–55.7, 183–195
See application file for complete search history.

(56) References Cited

U.S. PATENT DOCUMENTS

| | | | | |
|---|---|---|---|---|
| 3,936,240 | A | 2/1976 | Dochterman | |
| 3,951,589 | A * | 4/1976 | Alperin | A61K 8/418 8/415 |
| 4,948,344 | A * | 8/1990 | Cygnor | F04D 5/002 415/55.1 |
| 4,992,021 | A * | 2/1991 | Langen | F01N 3/025 415/13 |
| 5,143,511 | A | 9/1992 | Verneau et al. | |
| 7,033,137 | B2 * | 4/2006 | Shufeldt | F04D 23/008 415/119 |
| 2004/0219013 | A1 | 11/2004 | Hopfensperger | |
| 2008/0279681 | A1 | 11/2008 | Eguchi et al. | |
| 2013/0017078 | A1 | 1/2013 | Armstrong et al. | |

* cited by examiner

*Primary Examiner* — Hoang Nguyen
(74) *Attorney, Agent, or Firm* — Michael W. Goltry; Robert A. Parsons; Parsons & Goltry

(57) ABSTRACT

A regenerative blower includes an annular housing assembly that surrounds a rotating impeller and defines a toroidal flow channel, an inlet to admit fluid to the toroidal flow channel, an outlet to discharge fluid from the toroidal flow channel, a low fluid-pressure region of the toroidal flow channel proximate to the inlet, and a high fluid-pressure region of the toroidal flow channel proximate to the outlet. A non-contact interaction between concentric surface contours of the impeller and the housing assembly form opposed concentric fluid pathways between the impeller and the housing assembly from the high to low fluid-pressure regions of the toroidal flow channel. The opposed concentric fluid pathways are so convoluted as to restrict fluid from flowing therethrough from the high fluid-pressure region of the toroidal flow channel to the low fluid-pressure region of the toroidal flow channel.

12 Claims, 5 Drawing Sheets

REGENERATIVE BLOWER WITH A CONVOLUTED CONTACTLESS IMPELLER-TO-HOUSING SEAL ASSEMBLY

FIELD OF THE INVENTION

The present invention relates to regenerative blowers.

BACKGROUND OF THE INVENTION

Regenerative blowers are useful for moving large volumes of a fluid, such as air or other gas, at lower pressures or vacuums. Unlike positive displacement compressors and vacuum pumps, regenerative blowers, which are also referred to as side channel blowers or ring compressors, regenerate fluid molecules via non-positive displacement method to create vacuum or pressure. Regenerative blowers are used in a broad range of applications, such as pneumatic conveying, sewage aeration, vacuum lifting, vacuum packaging, packaging equipment, printing presses, aquaculture/pond aeration, spas, dryers, dust/smoke removal, industrial vacuum systems, soil vapor extraction, and chip removal for engraving equipment. Anywhere high fluid flow and low vacuum/pressure are required, regenerative blowers are an ideal solution as a properly installed regenerative blower will provide years of service-free operation.

A typical regenerative blower includes an impeller mounted directly to a motor shaft, which spins at the motor's nominal speed, such as 2900-3500 revolutions per minute. The impeller consists of numerous blades formed on its circumference. The number, size, and angle of these blades contribute to the pneumatic performance characteristics of the blower. The impeller spins within a housing assembly having a channel between an inlet and an outlet. As the impeller rotates, the fluid, such as air or other gas, is forced through the channel from the inlet to the outlet. The fluid is pressurized as it passes through the channel from the inlet to the outlet, in which the fluid discharged through the outlet is at a higher relative pressure than that of the fluid entering the channel through the inlet. The intake region of the channel near the inlet is the low pressure region of the blower, and the discharge region of the channel near the outlet is the high pressure region of the blower. As the fluid is forced through the channel from the inlet to the outlet, the fluid is captured between each blade on the impeller and is pushed both outward and forward into the channel. The fluid then returns to the base of the blade. This process is repeated over and over as the impeller spins, and it is this regeneration that gives the blower its pressure/vacuum capabilities. And so a regenerative blower operates like a staged reciprocal compressor and while each blade to blade regeneration stage results in only slight pressure increases, the sum total of the slight pressure increases through the channel from the inlet to the outlet can yield comparatively higher continuous operating pressures.

Regenerative blowers require little if any maintenance and monitoring because the impeller is wear-free because it does not come into contact with the housing assembly channel. Self-lubricated bearings are the only wearing parts. Regenerative blowers are oil-less and have no complicated intake and exhaust valving. Furthermore, most blower makes can be mounted in any plane and with dynamically balanced impellers that generate little vibration. Because there are few moving parts, regenerative blowers rarely fail unless they are installed or operated improperly.

However, regenerative blowers have close internal tolerances between the impeller and the housing assembly, which requires that the blower be kept free of debris that could become wedged between the impeller and housing assembly that could cause the blower to fail. A filter, such as a 10 micron filter, is often used to prevent the intake of unwanted debris, most manufacturers of regenerative blowers offer filters and relief valves as accessories for their blowers. Nevertheless, manufacturing the impeller and the housing assembly at close tolerances requires highly specialized equipment and is tedious and expensive. Furthermore, regenerative blowers are now being manufactured to allow the blade-to-blade regeneration stages to operate at increasingly higher pressures, such as from 1.2 to 1.4 psig, in order to produce increasingly higher discharge pressures. This is increasingly common in single-stage regenerative blowers. At these increased blade-to-blade regeneration stage pressures, however, leakage occurs between the impeller and the housing assembly from the high pressure to the low pressure region of the housing assembly, which reduces blower efficiency. Given these and other deficiencies in the art of regenerative blowers, continuing improvement in the art is evident.

SUMMARY OF THE INVENTION

According to the principle of the invention, regenerative blower includes an impeller being rotatable about an axis of rotation, and an annular housing assembly that surrounds the impeller. The annular housing assembly has a toroidal flow channel for a fluid, an inlet to admit fluid to the toroidal flow channel, an outlet to discharge fluid from the toroidal flow channel, a low fluid-pressure region of the toroidal flow channel proximate to the inlet, and an opposed high fluid-pressure region of the toroidal flow channel proximate to the outlet. Opposed concentric surface contours of the impeller and the annular housing assembly located between the toroidal flow channel and the axis of rotation of the impeller non-contact interact to form opposed concentric fluid pathways between the impeller and the annular housing assembly from the high fluid-pressure region of the toroidal flow channel to the low fluid-pressure region of the toroidal flow channel. The opposed concentric fluid pathways are so convoluted as to restrict fluid from flowing therethrough from the high fluid-pressure region of the toroidal flow channel to the low fluid-pressure region of the toroidal flow channel. The opposed concentric surface contours, and the opposed concentric fluid pathways defined by and between the opposed concentric surface contours, are continuous. Further, the opposed concentric fluid pathways are the mirror image of one another. The opposed concentric fluid pathways each extend in two directions from the high to low fluid-pressure regions of the toroidal flow channel, the two directions include a first direction and a different second direction intersecting the first direction at an angle. The first direction is a longitudinal direction being substantially orthogonal with respect to the axis of rotation of the impeller, the second direction is a transverse direction being substantially parallel with respect to the axis of rotation of the impeller, and the angle is a substantially right angle. Each of the opposed concentric fluid pathways preferably extend in the two directions at least one additional time. The opposed concentric surface contours of the impeller and the annular housing assembly comprise opposed concentric rings of tongues and complementing grooves.

According to the principle of the invention, regenerative blower includes an impeller being rotatable about an axis of rotation, and an annular housing assembly that surrounds the impeller. The annular housing assembly has a toroidal flow channel for a fluid, an inlet to admit fluid to the toroidal flow channel, an outlet to discharge fluid from the toroidal flow channel, a low fluid-pressure region of the toroidal flow channel proximate to the inlet, and an opposed high fluid-pressure region of the toroidal flow channel proximate to the outlet. In this embodiment, opposed, concentric, non-contacting interdigitated rings of the impeller and the annular housing assembly located between the toroidal flow channel and the axis of rotation of the impeller form opposed concentric fluid pathways between the impeller and the annular housing assembly from the high fluid-pressure region of the toroidal flow channel to the low fluid-pressure region of the toroidal flow channel. The opposed concentric fluid pathways are so convoluted as to restrict fluid from flowing therethrough from the high fluid-pressure region of the toroidal flow channel to the low fluid-pressure region of the toroidal flow channel. The opposed concentric fluid pathways are the mirror image of one another. The opposed concentric fluid pathways each extend in two directions from the high to low fluid-pressure regions of the toroidal flow channel, the two directions include a first direction and a different second direction intersecting the first direction at an angle. The first direction is a longitudinal direction being substantially orthogonal with respect to the axis of rotation of the impeller, the second direction is a transverse direction being substantially parallel with respect to the axis of rotation of the impeller, and the angle is a substantially right angle. The opposed concentric fluid pathways extend in the two directions at least one additional time.

BRIEF DESCRIPTION OF THE DRAWINGS

Referring to the drawings.

DETAILED DESCRIPTION

Figure 1:
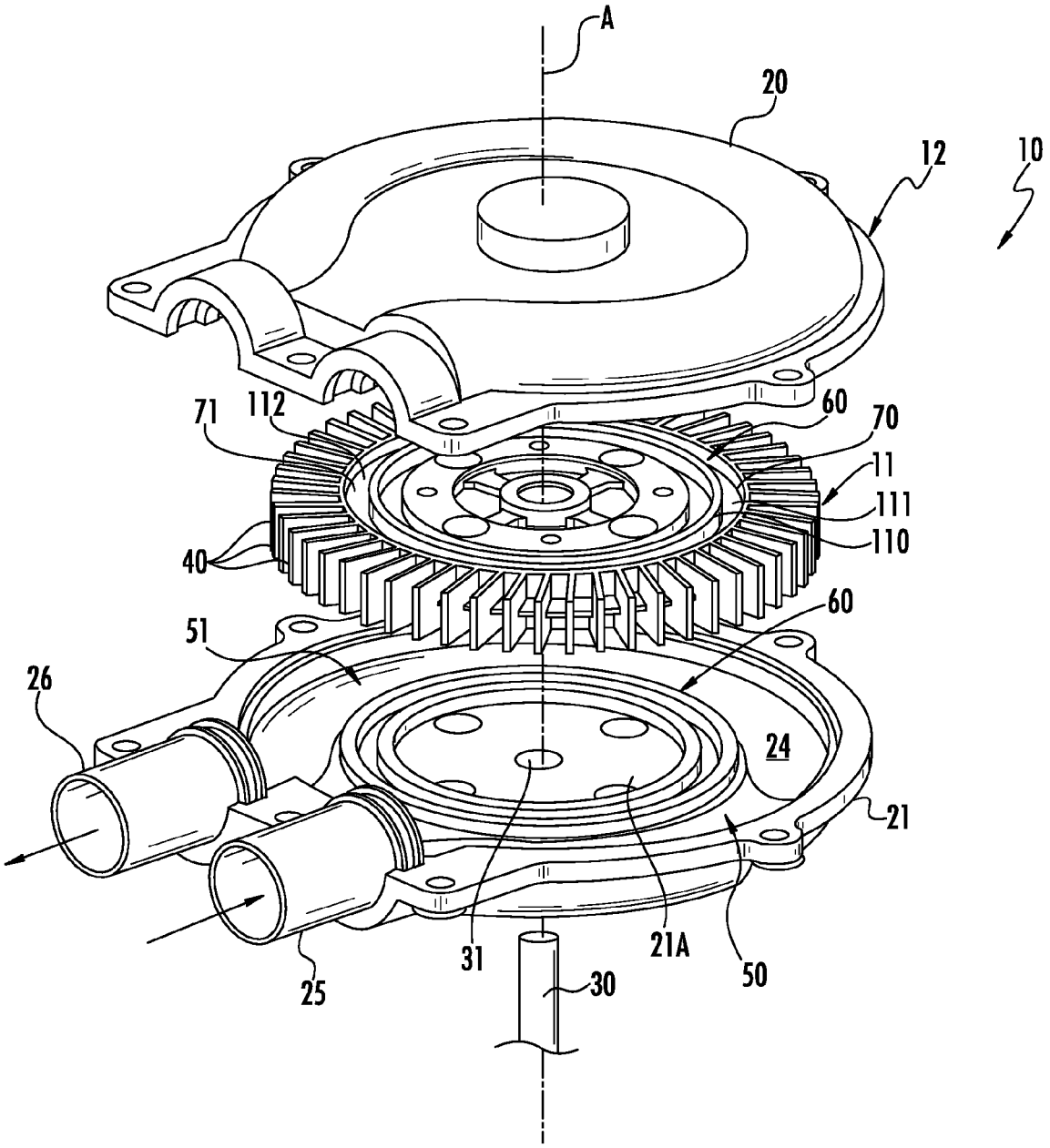
FIG. 1 is an isometric exploded view of a regenerative blower constructed and arranged in accordance with the principle of the invention, the regenerative blower including an impeller, an annular housing assembly, and a convoluted contactless impeller-to-housing seal assembly formed in the impeller and the annular housing assembly for restricting fluid from flowing therethrough from a high fluid-pressure region of a toroidal flow channel of the housing assembly to a low fluid-pressure region of the toroidal flow channel of the housing assembly.

Turning now to the drawings, in which like reference characters indicate corresponding elements throughout the several views, attention is directed in relevant part to FIGS. 1-4, in which there is illustrated a regenerative blower 10 constructed and arranged in accordance with the principle of the invention including an impeller 11 and an annular housing assembly 12. Impeller 11 is rotatable about an axis A of rotation, and annular housing assembly 12 surrounds impeller 11, as is well-known in the art. Annular housing assembly 12 consists of an upper part 20 and an opposed lower part 21, which are connected together to surround impeller 11. Upper and lower parts 20 and 21 are rigidly affixed together with fasteners (not shown), such as nut-and-bolt fasteners, as is well-known in the art. Annular housing assembly 12 defines the customary toroidal flow channel 24 for a fluid, namely, a gaseous fluid, such as air or other gas, an inlet 25 to admit the fluid to toroidal flow channel 24, and an outlet 26 to discharge the fluid from toroidal flow channel 24, and this arrangement is also well-known in the art.

Impeller 11 is mounted directly on a motor shaft 30 that passes through a hole 31 in the center of lower part 21 of annular housing assembly 12. Motor shaft 30 is driven for rotation by an electric motor (not shown), which, in turn, imparts rotation to impeller 11 in the direction of arcuate arrowed line B in 2 for driving the fluid through channel 24 from inlet 25 to outlet 26. Motor shaft 30 rotates impeller 11 at a chosen speed, such as about 2900-3500 revolutions per minute, which is a common and well-known range. Impeller 11 has numerous conventional blades 40 formed on its circumference. Impeller 11 extends radial outward from axis of rotation A to numerous blades 40, which reside in channel 24. The number, size, and angle of blades 40 are chosen so as to define the pneumatic performance characteristics of blower 10. Impeller 11 spins or otherwise rotates about axis of rotation A within housing assembly 12. As impeller 11 rotates, blades 40 rotate through channel 25, in the direction of arrowed line B in FIG. 2, which forces the fluid defined as a gaseous fluid, such as air or other gas, through channel 24 from inlet 25 to outlet 26. The fluid is increasingly pressurized as it passes through channel 24 from inlet 25 to outlet 26, in which the gas discharged through outlet 26 is at a higher relative pressure than that of the fluid entering channel 24 through inlet 25. The fluid thus translates through channel 24 from a low fluid-pressure region 50 of channel proximate to inlet 25 to a comparatively high fluid-pressure region 51 of channel 21 proximate to outlet 26. The intake region of channel 24 near, or otherwise proximate to, inlet 25 is low fluid-pressure region 50 of blower 10, and the discharge region of channel 24 near, or otherwise proximate to, outlet 26 is high fluid-pressure region 51 of blower 10. As the fluid is forced through channel 24 from inlet 25 to outlet 26 via spinning/rotating impeller 11, the fluid is captured between each blade 40 on the circumference of impeller 11 and is pushed both outward and forward into channel 24 and then back to the base of each blade 40. This process is repeated over and over as impeller 11 spins, and it is this regeneration that gives blower its pressure/vacuum capabilities. And so blower 10 operates like a staged reciprocal compressor and while each blade to blade regeneration stage results in only slight pressure increases, such as from 1.2-1.4 pounds per square inch gauge (psig) the sum total of the slight pressure increases through channel 24 from inlet 25 to outlet 26 can yield comparatively higher continuous operating pressures, such as approximately 3 psig. Impeller 11 does not come into contact with housing assembly 12 and, therefore, is wear-free so as to require little, if any, maintenance. Self-lubricated bearings (not shown) are the only wearing parts.

Blower 10 is generally representative of a conventional single-stage regenerative blower, in which the fluid travels through channel 24 from inlet 25 to outlet 26 only once. With the exception of the improvements to blower 10 discussed below, the further conventional details of blower 10 will readily occur to the skilled artisan and are not discussed.

Figure 2:
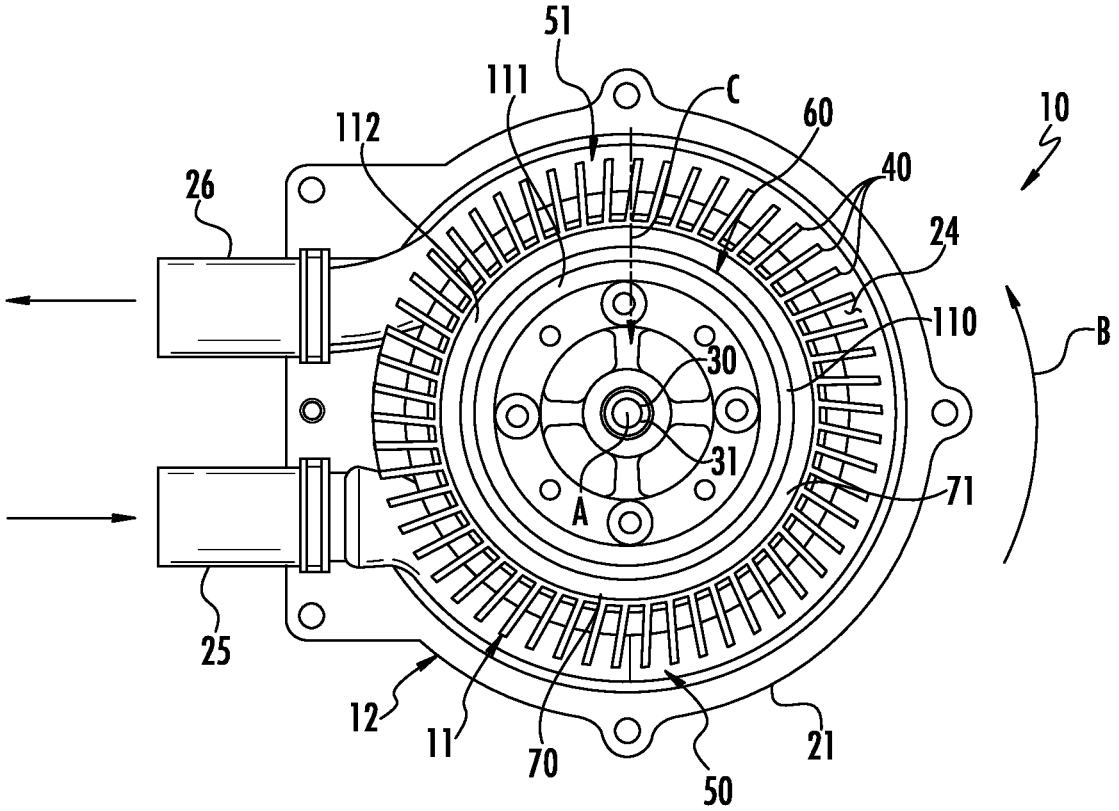
FIG. 2 is top plan view of the impeller and the lower part of the housing assembly of FIG. 1, illustrating the impeller applied to the lower part of the housing assembly.
Figure 3:
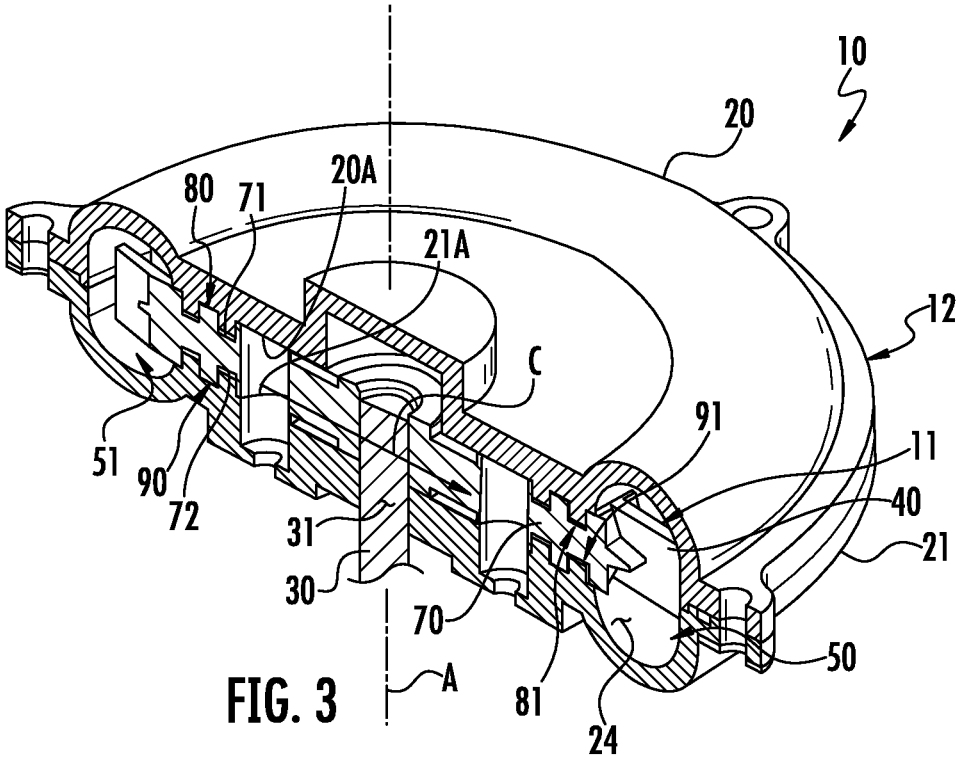
FIG. 3 is isometric vertical section view of the regenerative blower of FIG. 1 shown as it would appear assembled.
Figure 4:
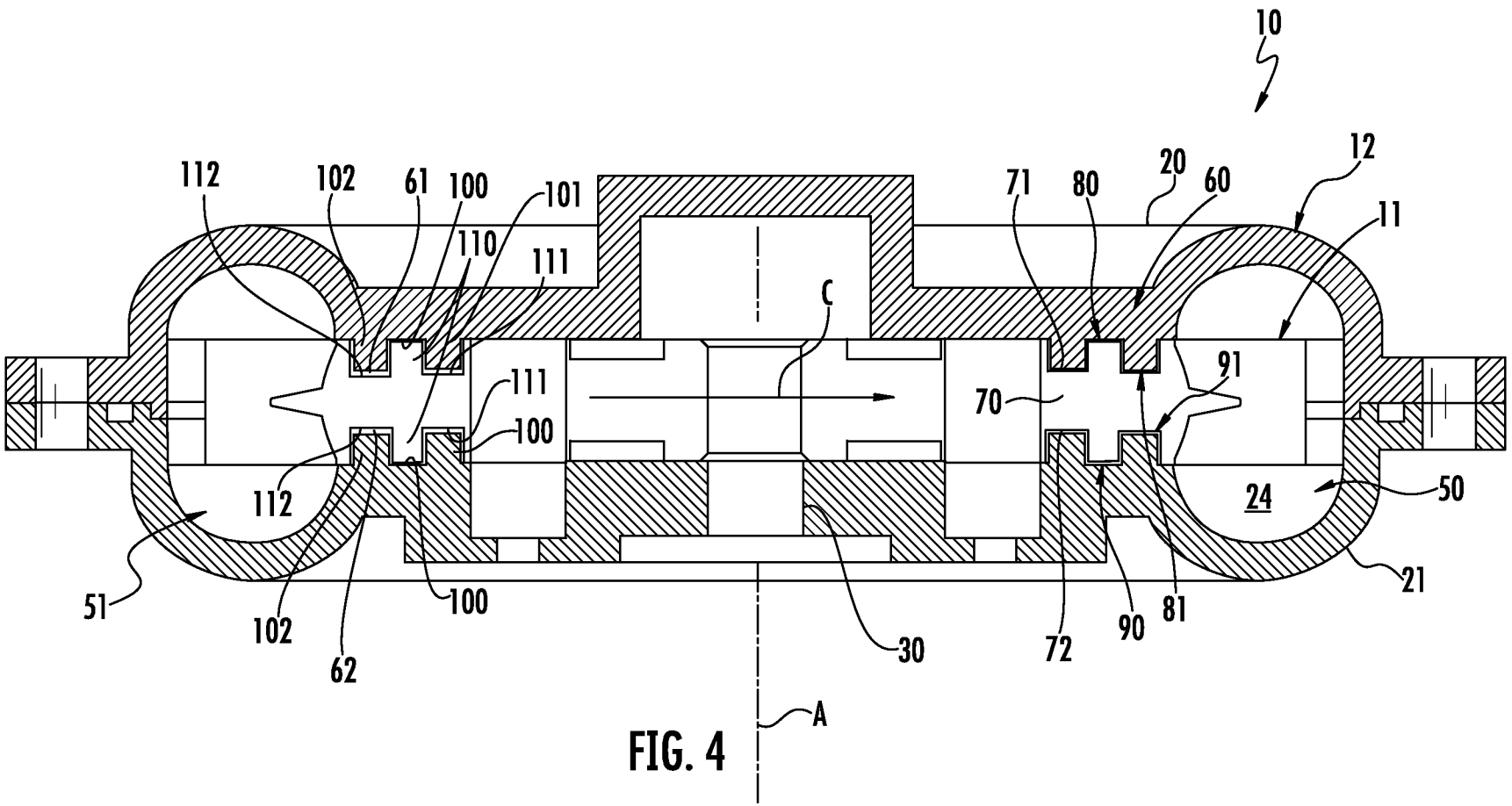
FIG. 4 is a front elevation view of the sectioned end of the embodiment of FIG. 3.

During operation, fluid in channel 24 tends to leak between impeller 11 and annular housing assembly 12 in the direction of arrowed line C, denoted in FIGS. 2-4, from high fluid-pressure region 51 of channel 24 to lower fluid-pressure region 50 of channel 24, which can reduce the operational efficiency of blower 20. The fluid leakage direction of arrowed line C is transverse across the region of axis of rotation A of impeller 11 from high fluid-pressure region 51 to low fluid-pressure region 50. The tendency of fluid to leak from high fluid-pressure region 51 to low fluid-pressure region in the direction of arrowed line C is a function of the pressure differential across the interior volume of blower 20 during blower 20 operations.

To solve this fluid leakage problem in blower 10 according to the principle of the invention so as to maintain the operational efficiency of blower 10, blower 10 is formed with a convoluted contactless impeller-to-housing seal assembly 60 formed in impeller 11 and annular housing assembly 12 for restricting fluid from flowing therethrough from high fluid-pressure region 51 of channel 24 to low fluid-pressure region 50 of channel 24, as in the direction of arrowed line C. This seal assembly forms opposed concentric fluid pathways referenced generally at 61 and 62, respectively, in FIGS. 4-6, between impeller 11 and annular housing assembly 12 from, as shown in FIG. 4, that in the direction of arrowed line C extend from high fluid-pressure region 51 of channel 24 to low fluid-pressure region 50 of channel 24. The opposed concentric fluid pathways 61 and 62 are, according to the invention, so convoluted as to restrict fluid from flowing therethrough in the direction of arrowed line C from high fluid-pressure region 51 of channel 24 to low fluid-pressure region 50 of channel 24, both at the high fluid-pressure region 51 of channel 24 and at low fluid-pressure region 50 of channel 24.

Impeller 11 has an annular middle or waist, denoted at 70 in FIGS. 1-5. Waist 70, as shown in FIGS. 1-4, is located between axis A of rotation of impeller 11 and blades 40 formed on impeller's 11 circumference, waist 70 is concentric with respect to axis A of rotation of impeller 11. Waist 70 has an upper or top side 71 that faces upwardly toward an inner side 20A of upper part 20 of annular housing assembly 12, and an opposed lower or bottom side 72 that faces downwardly toward an inner side 21A of lower part 21 of annular housing assembly 12.

Figure 5:
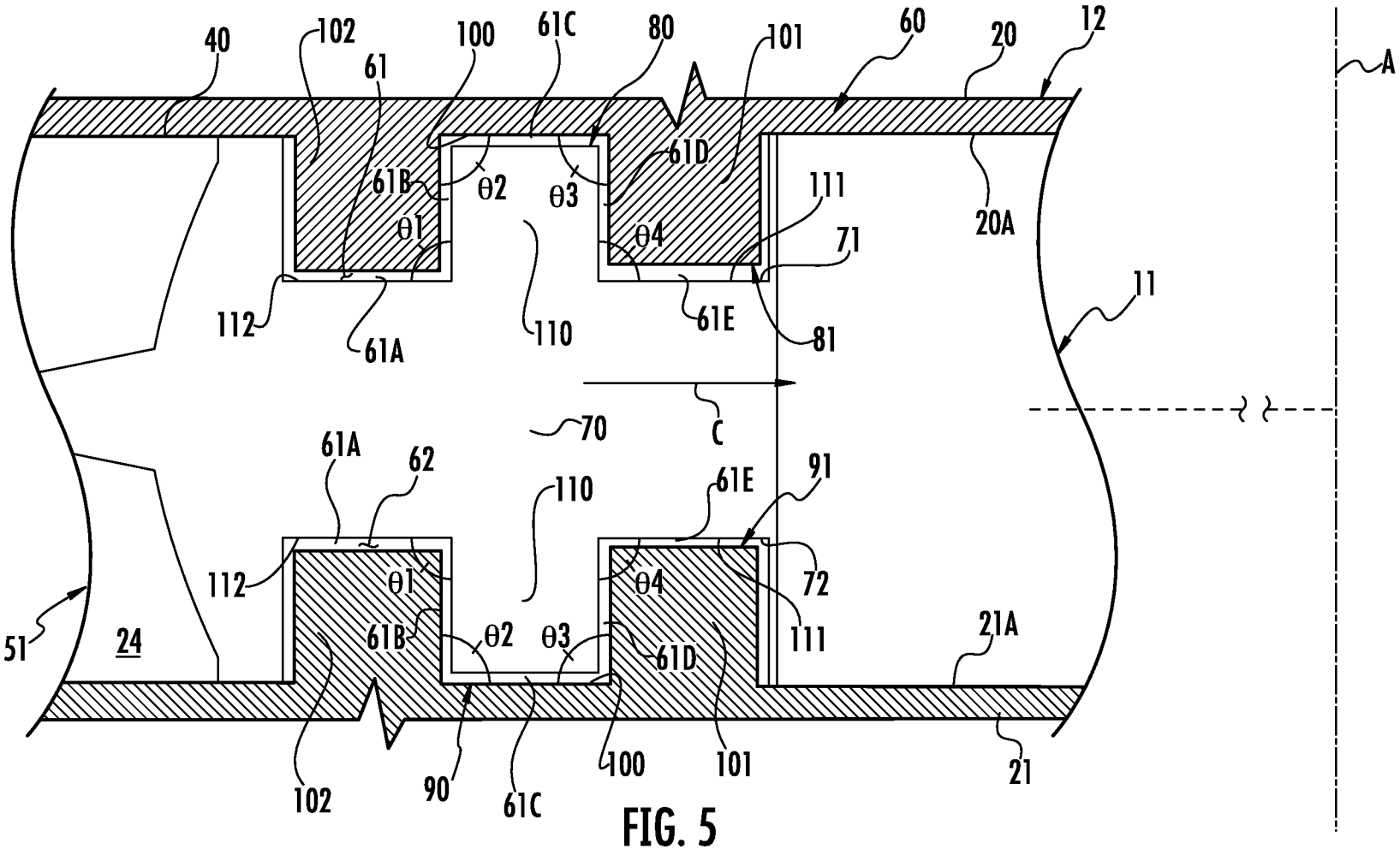
FIG. 5 is an enlarged, fragmented, highly generalized vertical section view illustrating opposed fluid pathways formed between the impeller and the annular housing assembly at a high fluid-pressure region of a toroidal flow channel of the annular housing assembly of FIG. 1.

Looking to FIGS. 3-5, upper side 71 of waist 70 and the opposed inner side 20A of upper part 20 of annular housing assembly 12 have opposed concentric surface contours denoted generally at 80 and 81, respectively. Surface contours 80 and 81 are machine parts of impeller 11 and upper part 20, respectively. Surface contours 80 and 81 are diametrically opposed and are continuous an unbroken and are rings, and are concentric relative to axis A of rotation of impeller 11 and are located between, on the one hand, channel 24 and blades 40 applied to channel 24, and, on the other hand, axis A of rotation of impeller 11. Surface contours 80 and 81 non-contact interact, meaning that they do not physically touch each other, so as to form concentric fluid pathway 61 (FIGS. 4-6) between upper side 71 of waist 70 of impeller 11 and inner side 20A of upper part 20 of annular housing assembly 12 that, in the direction of arrowed line C transversely across blower 20 from high fluid-pressure region 51 to low fluid-pressure region 51, extends from high fluid-pressure region 51 of channel 24 to low fluid-pressure region 50 of channel 24.

Lower side 72 of waist 70 and the opposed inner side 21A of lower part 21 of annular housing assembly 12 have opposed concentric surface contours denoted generally at 90 and 91, respectively. Surface contours 90 and 91 are machine parts of impeller 11 and lower part 21, respectively. Surface contours 90 and 91 are diametrically opposed, diametrically oppose surface contours 80 and 81, and are continuous an unbroken and are rings, and are concentric relative to axis A of rotation of impeller 11 and are located between, on the one hand, channel 24 and blades 40 applied to channel 24, and, on the other hand, axis A of rotation of impeller 11. Surface contours 90 and 91 non-contact interact, meaning that they do not physically touch each other, so as to form concentric fluid pathway 62 (FIGS. 4-6) between lower side 72 of waist 70 of impeller 11 and inner side 21A of lower part 21 of annular housing assembly 12 that, in the direction of arrowed line C transversely across blower 20 from high fluid-pressure region 51 to low fluid-pressure region 51, extends from high fluid-pressure region 51 of channel 24 to low fluid-pressure region 50 of channel 24. The non-contact interaction between surface contours 80 and 81 and surface contours 90 and 91 permit impeller 11 to spin freely without restriction.

Concentric fluid pathways 61 and 62 oppose one another, are continuous in that they are unbroken, and are rings or ring pathways that continuously encircle axis of rotation A of impeller 11, and are each so convoluted as to restrict fluid from flowing therethrough in the direction of arrowed line C from high fluid-pressure region 51 of channel 24 to low fluid-pressure region 50 of channel 24. Concentric fluid pathways 61 and 62 are convoluted or otherwise complicated so as to provide this resistance to fluid flow therethrough in that they extend in different directions and angles in the direction from high fluid-pressure region 51 of channel 24 to low fluid-pressure region 50 of channel 24 causing a resistance to fluid flow therethrough in the direction of arrowed line C from high fluid-pressure region 51 of channel 24 to low fluid-pressure region 50 of channel.

In the present embodiment, the opposed concentric surface contours 80 and 81 of impeller 11 and annular housing assembly 12, respectively, include or are otherwise defined by, opposed concentric features or parts of impeller 11 and annular housing assembly 12 located between channel 24 and axis of rotation A of rotation of impeller 11, which non-contact interact to form opposed concentric fluid pathways 61 and 62. These concentric parts consist of concentric and continuous complementing male and female elements herein in the form of concentric and continuous ring tongues and complementing concentric and continuous ring grooves.

Looking to FIGS. 4-5, surface contours 80, 81, 90, and 91 are illustrated. Surface contour 80 of impeller 11 is characterized by a central ring groove 100 separated by opposed ring tongues 101 and 102, and surface contour 81 of upper part 20 of annular housing assembly 12 is characterized by a central ring tongue 110 separated by opposed ring grooves 103, all of which are concentric relative to axis A of rotation of impeller 11. Central ring groove 100 of surface contour 80 non-contact receives ring tongue 110 of surface contour 81, ring groove 111 of surface contour 81 non-contact receives ring tongue 101 of surface contour 80, and ring groove 112 of surface contour 81 non-contact receives ring tongue 102 of surface contour 80, and this non-contact tongue-and-groove interaction forms concentric fluid pathway 61. As such, ring tongues 101, 102, and 110 are interdigitated, as clearly illustrated in FIG. 5, and define non-contacting interdigitated rings of impeller 11 and annular housing assembly 12 that form and define fluid pathway 61.

The non-contact interaction between ring tongue 101 and ring groove 111 form the innermost non-contact interaction between surface contours 80 and 81, the non-contact interaction between ring tongue 102 and ring groove 112 form the outermost non-contact interaction between surface contours 80 and 81, and the non-contact interaction between ring groove 100 and ring tongue 110 form the intermediate non-contact interaction between surface contours 80 and 81 that is flanked on either side by the innermost and outermost non-contact interactions between surface contours 80 and 81 so as to form fluid pathway 61.

Fluid pathway 61 is convoluted in that it extends in different directions from the high to low fluid-pressure regions 51 and 50 of channel 24. From high fluid-pressure region 51 as in FIG. 5, the different of fluid pathway 61 in the direction of arrowed line C from the high to low fluid-pressure regions 51 and 50 include a longitudinal direction 61A, between ring tongue 102 and ring groove 112, and a transverse direction 61B, between ring tongues 102 and 110, intersecting therewith at an angle Ø1. In the present embodiment, longitudinal direction 61A is substantially orthogonal with respect to the axis of rotation A of impeller 11, transverse direction 61B is substantially parallel with respect to axis A of rotation of impeller 11, and angle Ø1 is a substantially right angle. The term "substantially" as it is used here is used to accommodate the minor variations that may be appropriate to secure the invention described herein as would be understood by persons in the field of the invention.

The two directions of fluid pathway 61 along the outermost and intermediate non-contact interactions between surface contours 80 and 81 defines a convolution in fluid pathway 61 that restricts fluid flow therethrough in the direction of arrowed line C from the high to low fluid-pressure regions 51 and 50 of channel 24. As fluid tends to pass through directions 61A and 61B of fluid pathway 61 in the direction of arrowed line C from high fluid-pressure region 51 to low fluid-pressure region 50, the fluid 50 enters longitudinal direction 61A and flows toward transverse direction 61B, where it encounters angle Ø1 therebetween, which is an obstacle that obstructs fluid flow therethrough and where the fluid flow is disrupted and turbulated, which causes a resistance to the flow of fluid into transverse direction 61B from longitudinal direction 61A. And so the convolution of longitudinal and transverse directions 61A and 61B intersecting at angle Ø1 defines a convolution in fluid pathway 61, in which this convoluted section or obstacle of fluid pathway 61 is so convoluted so as to resist fluid from flowing therethrough, as described.

Additional directions of fluid pathway 61 in the direction of arrowed line C from the high to low fluid-pressure regions 51 and 50 include a longitudinal direction 61C, between ring groove 100 and ring tongue 110, intersecting transverse direction 61B at an obstacle in the form of angle Ø2, a transverse direction 61D, between ring tongues 110 and 101, intersecting longitudinal direction 61C at an obstacle in the form of angle Ø3, and a longitudinal direction 61E, between ring tongue 101 and ring groove 111, intersecting transverse direction 61D at an obstacle in the form of angle Ø4. In this embodiment, longitudinal direction 61C is substantially parallel to longitudinal direction 61A and is substantially orthogonal with respect to the axis of rotation A of impeller 11 and transverse direction 61B, the obstacle provided by angle Ø2 is a substantially right angle, transverse direction 61D is substantially parallel with respect to transverse direction 61B and axis of rotation A of impeller 11 and is substantially orthogonal with respect to longitudinal directions 61A and 61C, the obstacle provided by angle Ø3 is a substantially right angle, longitudinal direction 61E is substantially parallel to longitudinal direction 61C, is substantially in-line with respect to longitudinal direction 61A, and is substantially orthogonal with respect to the axis of rotation A of impeller 11 and transverse directions 61B and 61C, and the obstacle provided by angle Ø4 is a substantially right angle. Angles Ø1 and Ø2 are alternate interior angles on the opposed sides of transverse direction 61A, angles Ø2 and Ø3 opposed interior angles on the same side of longitudinal direction 61C, and angles Ø3 and Ø4 are alternate interior angles on the opposed sides of transverse direction 61D. The term "substantially" as it is used here is used to accommodate the minor variations that may be appropriate to secure the invention described herein as would be understood by persons in the field of the invention.

The additional directions of fluid pathway 61 defined between transverse direction 61B and longitudinal direction 61C, by along the outermost and intermediate non-contact interactions between surface contours 80 and 81, defined between transverse direction 61D and longitudinal direction 61C, by along the intermediate and innermost non-contact interactions between surface contours 80 and 81, and defined between longitudinal direction 61E and transverse direction 61D, by along the intermediate and innermost non-contact interactions between surface contours 80 and 81, define additional successive convolutions in fluid pathway 61 that each restrict fluid flow therethrough in the direction of arrowed line C from the high to low fluid-pressure regions 51 and 50 of channel 24.

As fluid may further tend to pass through directions 61B and 61C of fluid pathway 61 in the direction of arrowed line C from high fluid-pressure region 51 to low fluid-pressure region 50, the fluid 50 may enter transverse direction 61B and flow toward longitudinal direction 61C, where it encounters angle Ø2 therebetween, which is an obstacle that obstructs fluid flow therethrough and where the fluid flow is additionally disrupted and turbulated, which causes a further resistance to the flow of fluid into longitudinal direction 61C from transverse direction 61B. And so the convolution of transverse and longitudinal directions 61B and 61C intersecting at angle Ø2 defines another convolution in fluid pathway, in which this convoluted section or obstacle of fluid pathway 61 is so convoluted so as to resist fluid from flowing therethrough, as described.

As fluid may still further tend to pass through directions 61C and 61D of fluid pathway 61 in the direction of arrowed line C from high fluid-pressure region 51 to low fluid-pressure region 50, the fluid 50 may enter longitudinal direction 61C and flow toward transverse direction 61D, where it encounters angle Ø3 therebetween, which is an obstacle that obstructs fluid flow therethrough and where the fluid flow is yet again disrupted and turbulated, which causes yet a further layer of resistance to the flow of fluid into transverse direction 61D from longitudinal direction 61C. And so the convolution of longitudinal and transverse directions 61C and 61D intersecting at angle Ø3 defines yet another convolution in fluid pathway 61, in which this convoluted section or obstacle of fluid pathway 61 is so convoluted so as to still further resist fluid from flowing therethrough, as described.

As fluid may yet still further tend to pass through directions 61D and 61E of fluid pathway 61 in the direction of arrowed line C from high fluid-pressure region 51 to low fluid-pressure region 50, the fluid 50 may enter transverse direction 61D and flow toward longitudinal direction 61E, where it encounters angle Ø4 therebetween, which is an obstacle the obstructs fluid flow therethrough and where the fluid flow is yet still additionally disrupted and turbulated, which causes a yet still a further resistance to the flow of fluid into longitudinal direction 61E from transverse direction 61D. And so the additional convolution of transverse and longitudinal directions 61D and 61E intersecting at angle Ø4 defines still another convolution in fluid pathway, in which this convoluted section or obstacle of fluid pathway 61 is so convoluted so as to resist fluid from flowing therethrough, as described.

And so the convoluted nature of fluid pathway 61 defined by the described obstructions or convolutions, namely the obstruction/convolution provided by directions 61A and 61B intersecting at angle Ø1, the obstruction/convolution provided by directions 61B and 61C intersecting at angle Ø2, the obstruction/convolution the convolution provided by directions 61C and 61D intersecting at angle Ø3, and the obstruction/convolution provided by directions 61D and 61E intersecting at angle Ø4, provides a resistance to fluid flow therethrough at high fluid-pressure region 51 in the direction of arrowed line C from high fluid-pressure region 51 to low fluid-pressure region 50. Each described convoluted section or obstacle of fluid pathway 61 is so convoluted so as to resist fluid from flowing therethrough, and the sum total of the described convoluted sections or obstacles of fluid pathway 61 cooperate together to make fluid pathway 61 so convoluted so as to resist fluid from flowing therethrough, in accordance with the principle of the invention.

In the present embodiment, longitudinal directions 61A, 61C, and 61E of fluid pathway 61 are equal in length, and transverse directions 61B and 61D are equal in length, and these directions cooperate as to form a checkerboard edge-shaped fluid pathway, as illustrated. The lengths of directions may vary somewhat, if so desired.

Surface contour 90 of impeller 11 is identical to and is the mirror image opposite of and functions identically to surface contour 80 of impeller 11, and surface contour 91 of lower part 21 is the identical to and is the mirror image of and functions identically to surface contour 81 of upper part 20. As such, the same reference characters used to describe the features of surface contours 80 and 81 are used below to describe common features of surface contours 90 and 91.

In common with surface contours 80 and 81, surface contour 90 of impeller 11 is characterized by central ring groove 100 separated by opposed ring tongues 101 and 102, and surface contour 91 of lower part 21 of annular housing assembly 12 is characterized by central ring tongue 110 separated by opposed ring grooves 103, all of which are concentric relative to axis A of rotation of impeller 11. Central ring groove 100 of surface contour 90 non-contact receives ring tongue 110 of surface contour 91, ring groove 111 of surface contour 91 non-contact receives ring tongue 101 of surface contour 90, and ring groove 112 of surface contour 91 non-contact receives ring tongue 102 of surface contour 90, and this non-contact tongue-and-groove interaction forms concentric fluid pathway 62. As such, ring tongues 101, 102, and 110 are interdigitated, as clearly illustrated in FIG. 5, and define non-contacting interdigitated rings of impeller 11 and annular housing assembly 12 that form and define fluid pathway 62.

The non-contact interaction between ring tongue 101 and ring groove 111 form the innermost non-contact interaction between surface contours 90 and 91, the non-contact interaction between ring tongue 102 and ring groove 112 form the outermost non-contact interaction between surface contours 90 and 91, and the non-contact interaction between ring groove 100 and ring tongue 110 form the intermediate non-contact interaction between surface contours 90 and 91 that is flanked on either side by the innermost and outermost non-contact interactions between surface contours 90 and 91 so as to form fluid pathway 62.

Fluid pathway 62 is convoluted in that it extends in different directions from the high to low fluid-pressure regions 51 and 50 of channel 24. From high fluid-pressure region 51 as in FIG. 5, the different of fluid pathway 62 in the direction of arrowed line C from the high to low fluid-pressure regions 51 and 50 include longitudinal direction 61A, between ring tongue 102 and ring groove 112, and a transverse direction 61B, between ring tongues 102 and 110, intersecting therewith at an angle Ø1. In the present embodiment, longitudinal direction 61A is substantially orthogonal with respect to the axis of rotation A of impeller 11, transverse direction 61B is substantially parallel with respect to axis A of rotation of impeller 11, and angle Ø1 is a substantially right angle. The term "substantially" as it is used here is used to accommodate the minor variations that may be appropriate to secure the invention described herein as would be understood by persons in the field of the invention.

The two directions of fluid pathway 62 along the outermost and intermediate non-contact interactions between surface contours 90 and 91 defines a convolution in fluid pathway 62 that restricts fluid flow therethrough in the direction of arrowed line C from the high to low fluid-pressure regions 51 and 50 of channel 24. As fluid tends to pass through directions 61A and 61B of fluid pathway 62 in the direction of arrowed line C from high fluid-pressure region 51 to low fluid-pressure region 50, the fluid 50 enters longitudinal direction 61A and flows toward transverse direction 61B, where it encounters angle Ø1 therebetween, which is an obstacle that obstructs fluid flow therethrough and where the fluid flow is disrupted and turbulated, which causes a resistance to the flow of fluid into transverse direction 61B from longitudinal direction 61A. And so the convolution of longitudinal and transverse directions 61A and 61B intersecting at angle Ø1 defines a convolution in fluid pathway 62, in which this convoluted section or obstacle of fluid pathway 62 is so convoluted so as to resist fluid from flowing therethrough, as described.

Additional directions of fluid pathway 62 in the direction of arrowed line C from the high to low fluid-pressure regions 51 and 50 include a longitudinal direction 61C, between ring groove 100 and ring tongue 110, intersecting transverse direction 61B at an obstacle in the form of angle Ø2, a transverse direction 61D, between ring tongues 110 and 101, intersecting longitudinal direction 61C at an obstacle in the form of angle Ø3, and a longitudinal direction 61E, between ring tongue 101 and ring groove 111, intersecting transverse direction 61D at an obstacle in the form of angle Ø4. In this embodiment, longitudinal direction 61C is substantially parallel to longitudinal direction 61A and is substantially orthogonal with respect to the axis of rotation A of impeller 11 and transverse direction 61B, angle Ø2 is a substantially right angle, transverse direction 61D is substantially parallel with respect to transverse direction 61B and axis of rotation A of impeller 11 and is substantially orthogonal with respect to longitudinal directions 61A and 61C, angle Ø3 is a substantially right angle, longitudinal direction 61E is substantially parallel to longitudinal direction 61C, is substantially in-line with respect to longitudinal direction 61A, and is substantially orthogonal with respect to the axis of rotation A of impeller 11 and transverse directions 61B and 61C, and angle Ø4 is a substantially right angle. The term "substantially" as it is used here is used to accommodate the minor variations that may be appropriate to secure the invention described herein as would be understood by persons in the field of the invention.

The additional directions of fluid pathway 62 defined between transverse direction 61B and longitudinal direction 61C, by along the outermost and intermediate non-contact interactions between surface contours 90 and 91, defined between transverse direction 61D and longitudinal direction 61C, by along the intermediate and innermost non-contact interactions between surface contours 90 and 91, and defined between longitudinal direction 61E and transverse direction 61D, by along the intermediate and innermost non-contact interactions between surface contours 90 and 91, define additional successive convolutions in fluid pathway 62 that restrict fluid flow therethrough in the direction of arrowed line C from the high to low fluid-pressure regions 51 and 50 of channel 24.

As fluid may further tend to pass through directions 61B and 61C of fluid pathway 62 in the direction of arrowed line C from high fluid-pressure region 51 to low fluid-pressure region 50, the fluid 50 may enter transverse direction 61B and flow toward longitudinal direction 61C, where it encounters angle Ø2 therebetween, which is an obstacle that obstructs fluid flow therethrough and where the fluid flow is additionally disrupted and turbulated, which causes a further resistance to the flow of fluid into longitudinal direction 61C from transverse direction 61B. And so the convolution of transverse and longitudinal directions 61B and 61C intersecting at angle Ø2 defines another convolution in fluid pathway, in which this convoluted section or obstacle of fluid pathway 62 is so convoluted so as to resist fluid from flowing therethrough, as described.

As fluid may still further tend to pass through directions 61C and 61D of fluid pathway 62 in the direction of arrowed line C from high fluid-pressure region 51 to low fluid-pressure region 50, the fluid 50 may enter longitudinal direction 61C and flow toward transverse direction 61D, where it encounters angle Ø3 therebetween, which is an obstacle that obstructs fluid flow therethrough and where the fluid flow is yet again disrupted and turbulated, which causes yet a further layer of resistance to the flow of fluid into transverse direction 61D from longitudinal direction 61C. And so the convolution of longitudinal and transverse directions 61C and 61D intersecting at angle Ø3 defines yet another convolution in fluid pathway 62, in which this convoluted section or obstacle of fluid pathway 62 is so convoluted so as to still further resist fluid from flowing therethrough, as described.

As fluid may yet still further tend to pass through directions 61D and 61E of fluid pathway 62 in the direction of arrowed line C from high fluid-pressure region 51 to low fluid-pressure region 50, the fluid 50 may enter transverse direction 61D and flow toward longitudinal direction 61E, where it encounters angle Ø4 therebetween, which is an obstacle that obstructs fluid flow therethrough and where the fluid flow is yet still additionally disrupted and turbulated, which causes a yet still a further resistance to the flow of fluid into longitudinal direction 61E from transverse direction 61D. And so the additional convolution of transverse and longitudinal directions 61D and 61E intersecting at angle Ø4 defines still another convolution in fluid pathway, in which this convoluted section or obstacle of fluid pathway 62 is so convoluted so as to resist fluid from flowing therethrough, as described.

And so the convoluted nature of fluid pathway 62 defined by the described obstructions or convolutions, namely the obstruction/convolution provided by directions 61A and 61B intersecting at angle Ø1, the obstruction/convolution provided by directions 61B and 61C intersecting at angle Ø2, the obstruction/convolution the convolution provided by directions 61C and 61D intersecting at angle Ø3, and the obstruction/convolution provided by directions 61D and 61E intersecting at angle Ø4, provides a resistance to fluid flow therethrough at high fluid-pressure region 51 in the direction of arrowed line C from high fluid-pressure region 51 to low fluid-pressure region 50. Each described convoluted section or obstacle of fluid pathway 62 is so convoluted so as to resist fluid from flowing therethrough, and the sum total of the described convoluted sections or obstacles of fluid pathway 62 cooperate together to make fluid pathway 62 so convoluted so as to resist fluid from flowing therethrough, in accordance with the principle of the invention.

In the present embodiment, longitudinal directions 61A, 61C, and 61E of fluid pathway 62 are equal in length, and transverse directions 61B and 61D are equal in length, and these directions cooperate as to form a checkerboard edge-shaped fluid pathway, as illustrated. The lengths of directions may vary somewhat, if so desired. Fluid pathways 61 and 62 are equal in length in this preferred embodiment.

Figure 6:
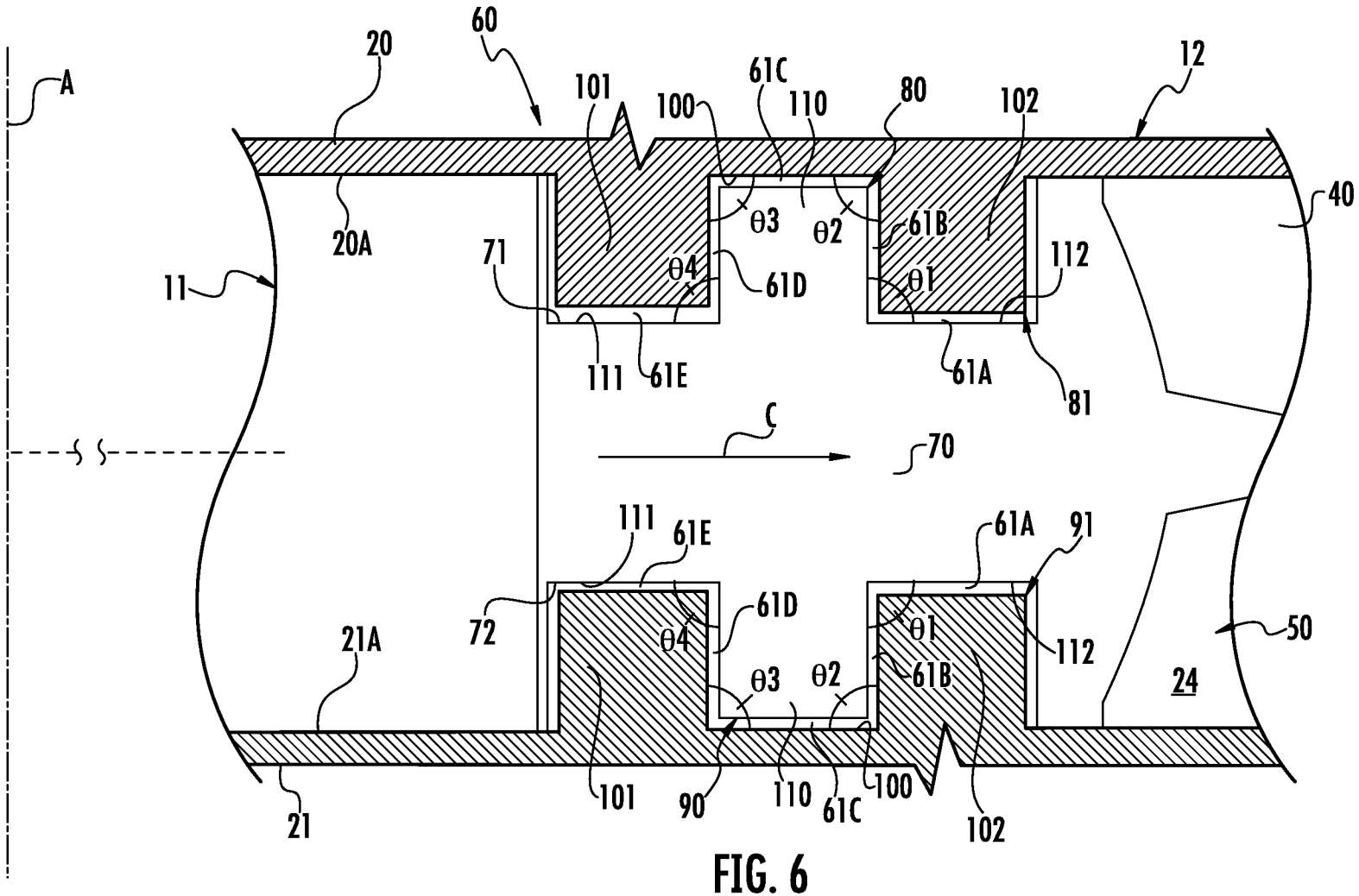
FIG. 6 is a view similar to that of FIG. 5 illustrating the opposed fluid pathways formed between the impeller and the annular housing assembly at a low fluid-pressure region of the toroidal flow channel of the annular housing assembly.

As a matter of illustration and reference, FIG. 6 is a view similar to that of FIG. 5 illustrating opposed fluid pathways 61 and 62 at low fluid-pressure region 50 of channel 24, and the reference characters of FIG. 5 are also denoted in FIG. 6 for illustration and reference. In this configuration, the convolution of fluid pathways 61 and 62 restrict fluid flow therethrough in the direction of arrowed line C from high to low fluid-pressure regions of channel 24 in the manner described above, albeit reversed in a direction from the innermost non-contact interaction between surface contours 80 and 81 and surface contours 90 and 91 to the outermost non-contact interaction between surface contours 80 and 81 and surface contours 90 and 91, in which the convolution of fluid pathways 61 and 62 restricts fluid flow therethrough from longitudinal direction 61E to longitudinal direction 61A of fluid pathways 61 and 62.

In accordance with this disclosure, fluid pathways 61 and 62 are so convoluted so as to so as to restrict fluid from flowing therethrough, as described. The convoluted nature of fluid pathways 61 and 62 allows looser tolerances, such as approximately twenty thousandths of an inch, in the dimensions of fluid pathways 61 and 62 between impeller 11 and annular housing assembly 12 than is currently required in conventional regenerative blowers, which can reduce manufacturing costs. The tolerances of the dimensions of fluid pathways 61 and 62 can be less than twenty thousandths of an inch in other embodiments, if so desired. The described surface contours 80, 81, 90, and 91 define fluid pathways 61 and 62, and the convolutions defined by the different described directions of fluid pathways 61 and 62, including the angles of intersection between the corresponding directions, define the convoluted characteristics of fluid pathways 61 and 62 causing them to resist fluid flow therethrough as described. Other forms of surface contours or texturing can be used for surface contours 80, 81, 90, and 91, consistent with the teachings set forth herein. According to this disclosure, the different directions of fluid pathways 61 and 62 are longitudinal and transverse directions that intersect at angles, which are preferably right angles. Other acute and/or oblique fluid pathway directions that intersect at oblique angles, such as acute and/or obtuse angles, can be used if so desired to provide the convoluted obstructions and characteristics of fluid pathways 61 and 62.

According to this disclosure, regenerative blower 10 incorporates convoluted contactless impeller-to-housing seal assembly 60 formed in impeller 11 and annular housing assembly 12 that includes fluid pathways 61 and 62 that are so convoluted so as to restrict fluid from flowing therethrough between impeller 11 and annular housing assembly 12 from high fluid-pressure region 51 of channel 24 to low fluid-pressure region 50 of channel 24, as in the direction of arrowed line C, at both the high fluid-pressure region 51 of channel 24 and low fluid-pressure region 50 of channel 24. The different directions 61A-61E of fluid pathways 61 and 62 increase the path of any fluid leakage from the high to low fluid-pressure regions 50 and 51 of channel 24 while forcing any leaking fluid to make a number of angled turns through the various obstructions/angles, which are angles Ø1, Ø2, Ø3, and Ø4 in the present embodiment. Less or more intersecting fluid pathways and corresponding angles can be used in fluid pathways 61 and 62 so as to function as do fluid pathways 61 and 62 according to this disclosure without departing from the invention. As such, other numbers of ring tongues and corresponding ring grooves, or other form of concentric and continuous complementing male and female elements, can be used in the opposed concentric surface contours 80 and 81 of impeller 11 and annular housing assembly 12, respectively, so as to form other numbers of intersecting fluid pathways without departing from the invention. Although annular housing assembly 12 is fashioned of two main parts in the present embodiment, namely, upper and lower parts 20 and 21, it can be fashioned of more than two parts, if so desired, including opposed side parts and possibly one or more middle parts between two or more perimeter parts. Furthermore, although seal assembly 60 is disclosed in a single stage regenerative blower in this embodiment, it can be incorporated into multiple stage regenerative blower in the same manner as herein described.

The invention has been described above with reference to preferred embodiments. However, those skilled in the art will recognize that changes and modifications may be made to the embodiments without departing from the nature and scope of the invention. Various changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A regenerative blower, comprising:

an impeller, the impeller is rotatable about an axis of rotation;

an annular housing assembly surrounds the impeller and has a toroidal flow channel for a fluid, an inlet to admit fluid to the toroidal flow channel, and an outlet to discharge fluid from the toroidal flow channel, the toroidal flow channel extends through the annular housing assembly from the inlet to the outlet;

the impeller extends radially outward from the axis of rotation to blades that reside in the toroidal flow channel, and includes an upper side and a lower side;

the blades rotate through the toroidal flow channel forcing fluid through the toroidal flow channel from the inlet to the outlet, when impeller rotates about the axis of rotation;

a low fluid-pressure region of the toroidal flow channel proximate to the inlet, and an opposed high fluid-pressure region of the toroidal flow channel proximate to the outlet; and opposed concentric surface contours of the upper side and the lower side of the impeller and the annular housing assembly extend transversely relative the axis of rotation of the impeller in a direction from the high fluid-pressure region of the toroidal flow channel to the low fluid-pressure region of the toroidal flow channel and are located between the toroidal flow channel and the axis of rotation of the impeller, the opposed concentric surface contours of the upper side and the lower side of the impeller and the annular housing assembly non-contact interact to form opposed concentric fluid pathways between the upper side and the lower side of the impeller and the annular housing assembly from the high fluid-pressure region of the toroidal flow channel to the low fluid-pressure region of the toroidal flow channel, the opposed concentric fluid pathways being so convoluted as to restrict fluid from flowing therethrough from the high fluid-pressure region of the toroidal flow channel through the annular housing assembly across a region of the axis of rotation of the impeller to the low fluid-pressure region of the toroidal flow channel.

2. The regenerative blower according to claim 1, wherein the opposed concentric surface contours, and the opposed concentric fluid pathways defined by and between the opposed concentric surface contours, are continuous.

3. The regenerative blower according to claim 2, wherein the opposed concentric fluid pathways are the mirror image of one another.

4. The regenerative blower according to claim 2, wherein the opposed concentric fluid pathways each extend in two directions from the high to low fluid-pressure regions of the toroidal flow channel, the two directions comprising a first direction and a different second direction intersecting the first direction at an angle.

5. The regenerative blower according to claim 4, wherein the first direction is a longitudinal direction being substantially orthogonal with respect to the axis of rotation of the impeller, the second direction is a transverse direction being substantially parallel with respect to the axis of rotation of the impeller, and the angle is a substantially right angle.

6. The regenerative blower according to claim 4, wherein each of the opposed concentric fluid pathways extend in the two directions at least one additional time.

7. The regenerative blower according to claim 5, wherein the opposed concentric surface contours of the impeller and the annular housing assembly comprise opposed concentric rings of tongues and complementing grooves.

8. A regenerative blower, comprising:

an impeller, the impeller is rotatable about an axis of rotation;

an annular housing assembly surrounds the impeller and has a toroidal flow channel for a fluid, an inlet to admit fluid to the toroidal flow channel, and an outlet to discharge fluid from the toroidal flow channel, the toroidal flow channel extends through the annular housing assembly from the inlet to the outlet;

the impeller extends radially outward from the axis of rotation to blades that reside in the toroidal flow channel, and includes an upper side and a lower side;

the blades rotate through the toroidal flow channel forcing fluid through the toroidal flow channel from the inlet to the outlet, when impeller rotates about the axis of rotation;

a low fluid-pressure region of the toroidal flow channel proximate to the inlet, and an opposed high fluid-pressure region of the toroidal flow channel proximate to the outlet; and opposed, concentric, non-contacting interdigitated rings of the upper side and the lower side of the impeller and the annular housing assembly extend transversely relative the axis of rotation of the impeller in a direction from the high fluid-pressure region of the toroidal flow channel to the low fluid-pressure region of the toroidal flow channel and are located between the toroidal flow channel and the axis of rotation of the impeller, the opposed, concentric, non-contacting interdigitated rings of the upper side and the lower side of the impeller and the annular housing assembly non-contact interact to form opposed concentric fluid pathways between the upper side and the lower side of the impeller and the annular housing assembly from the high fluid-pressure region of the toroidal flow channel to the low fluid-pressure region of the toroidal flow channel, the opposed concentric fluid pathways being so convoluted as to restrict fluid from flowing therethrough from the high fluid-pressure region of the toroidal flow channel through the annular housing assembly across a region of the axis of rotation of the impeller to the low fluid-pressure region of the toroidal flow channel.

9. The regenerative blower according to claim 8, wherein the opposed concentric fluid pathways are the mirror image of one another.

10. The regenerative blower according to claim 9, wherein the opposed concentric fluid pathways each extend in two directions from the high to low fluid-pressure regions of the toroidal flow channel, the two directions comprising a first direction and a different second direction intersecting the first direction at an angle.

11. The regenerative blower according to claim 10, wherein the first direction is a longitudinal direction being substantially orthogonal with respect to the axis of rotation of the impeller, the second direction is a transverse direction being substantially parallel with respect to the axis of rotation of the impeller, and the angle is a substantially right angle.

12. The regenerative blower according to claim 10, wherein each of the opposed concentric fluid pathways extend in the two directions at least one additional time.

* * * * *